United States Patent [19]

Morton et al.

[11] Patent Number: 4,792,024

[45] Date of Patent: Dec. 20, 1988

[54] CHANGING CADDY INCLUDING A REMOVABLE CHANGING PAD FOR AN INFANT

[75] Inventors: Kenneth P. Morton, East Aurora; Daniel J. D'Arcy, Lancaster; Merry S. Riehm, Buffalo, all of N.Y.

[73] Assignee: The Quaker Oats Company, Chicago, Ill.

[21] Appl. No.: 107,647

[22] Filed: Oct. 9, 1987

[51] Int. Cl.[4] ..... A45C 9/00; A45F 4/06; A47D 13/00

[52] U.S. Cl. ..... 190/1; 150/48; 150/51; 206/216; 206/548; 217/124; 383/4; 224/151; 224/156; 5/420

[58] Field of Search ..... 190/1, 2, 8; 224/151, 224/158, 156; 5/417–420; 383/4; 206/548, 216, 218; 217/3 CV, 124; 150/48, 50, 51; 229/914

[56] References Cited

U.S. PATENT DOCUMENTS

| | | | |
|---|---|---|---|
| 2,542,477 | 2/1951 | Cart | 383/4 X |
| 2,738,834 | 3/1956 | Jaffe et al. | 5/420 |
| 3,489,194 | 1/1970 | Hoover | 190/1 X |
| 4,068,786 | 1/1978 | Taniguchi | 190/2 X |
| 4,350,194 | 9/1982 | Brown | 190/110 X |
| 4,566,130 | 1/1986 | Coates | 190/1 X |

FOREIGN PATENT DOCUMENTS

| | | | |
|---|---|---|---|
| 2478972 | 10/1981 | France | 190/1 |
| 2507454 | 12/1982 | France | 190/2 |
| 2054388 | 2/1981 | United Kingdom | 190/1 |
| 2061712 | 5/1981 | United Kingdom | 190/2 |

*Primary Examiner*—Sue A. Weaver
*Attorney, Agent, or Firm*—Cumpston & Shaw

[57] ABSTRACT

A changing caddy is described for carrying the items necessary to change an infant and providing a changing pad. The changing caddy includes a basket having a generally upstanding U-shaped handle attached to a generally rectangular body having four sides, and a pad having at least one moisture resistant surface. The pad has a plurality of fold lines for causing the pad to assume the contour of the outside configuration of the basket when folded. The pad has first and second sides and first and second ends, and connectors are provided on end plates attached to the ends for removably attaching the first and second ends together adjacent to said handle and for removably attaching the first and second sides to the ends of the basket.

16 Claims, 2 Drawing Sheets

CHANGING CADDY INCLUDING A REMOVABLE CHANGING PAD FOR AN INFANT

This invention relates to apparatus for transporting the supplies and a changing pad needed to change an infant.

For convenience, as used herein, "change" and "changing" refer to all of the activities associated with replacing soiled infant's clothing, including diapers, with clean clothing.

When infants and young children accompany their parents on trips away from home, it is often necessary to bring along the items needed to change the infant's diapers. Among these items are clean diapers, and preferably a portable pad on which the infant can be placed during changing. Providing such a pad eliminates the need to find a clean, moisure resistant surface whenever changing is required. Although all of the items necessary for changing children are separately available, and can be gathered and placed in suitable transportable container when they are needed, there is a need for a more convenient system.

Accordingly, it is an object of this invention to provide a changing caddy that includes a basket for holding changing supplies, and a suitable changing pad that can be attached to the basket and transported therwith as a unit, and easily removed from the basket for use when needed.

Briefly stated and in accordance with one aspect of this invention, a changing caddy is provided for carrying the items necessary to change an infant and providing a changing pad. The changing caddy includes a basket having a generally upstanding U-shaped handle attached to a generally rectangular body having four sides. A pad having at least one moisture resistant surface is provided, said pad having a plurality of fold lines for causing the pad to assume the contour of the outside configuration of the basket when the pad is folded. The pad has first and second sides and first and second ends, and connectors are provided on the basket and the pad for removably attaching the first and second ends to said handle and for removably attaching the first and second sides to the ends of the basket.

The novel aspects of this invention are set forth with particularity in the appended claims. The invention itself may be more readily understood by referring to the following detailed description of the presently preferred embodiment thereof in conjunction with the following drawings in which:

Figure 1:
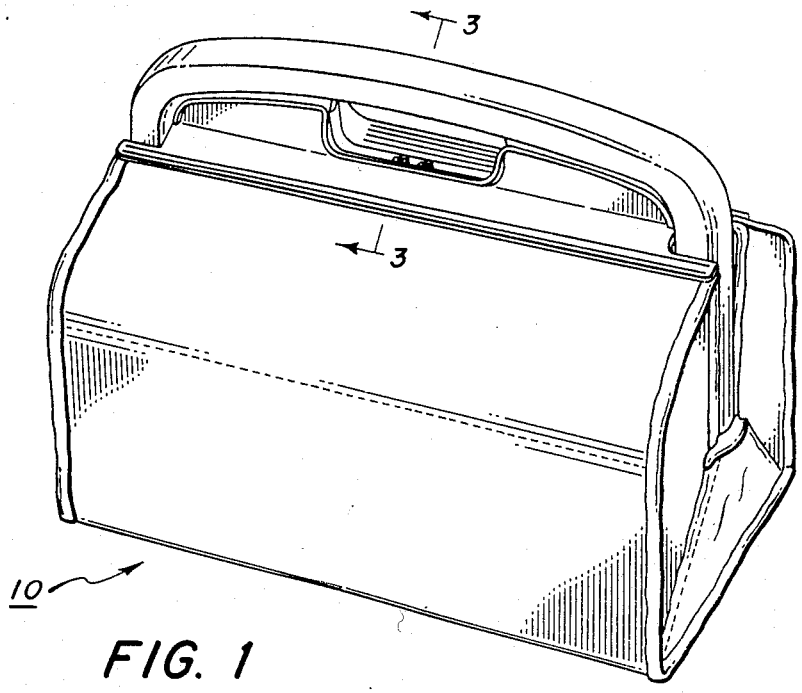
FIG. 1 is a perspective view of a changing caddy in accordance with this invention, showing the changing caddy in its transportable configuration.
Figure 2:
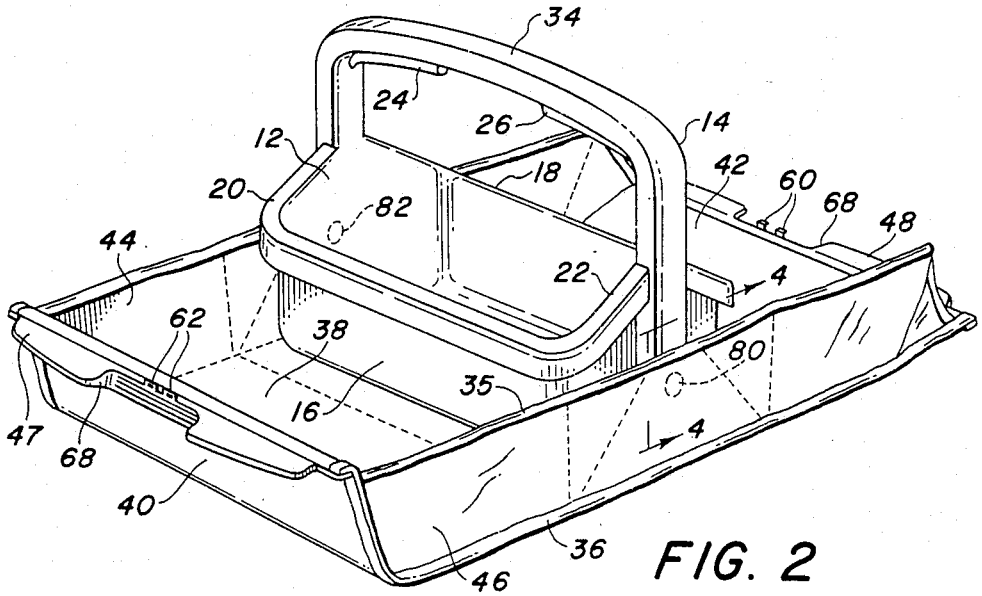
FIG. 2 is a perspective view of a changing caddy in accordance with this invention, showing the changing caddy in its open configuration.

Referring now to FIGS. 1 and 2, a changing caddy 10 in accordance with this invention is shown in two perspective views illustrating the caddy in its open and closed configurations respectively. The changing caddy includes a basket 12 for carrying changing supplies and having a generally U-shaped handle 14. Preferably the basket is molded from plastic or some other suitable material that is strong and moisture resistant so that soiled diapers can be temporarily carried therein if there is no convenient place to dispose of them. The basket is generally rectangular in configuration and has two long sides 16 and 18 and two ends 20 and 22. Preferably, the handle 14 is attached to the ends 20 and 22 of the basket 12 and extends down the ends to the bottom of the basket.

First and second depending flanges 24 and 26 extend downwardly from the underneath surface 28 of the handle. The handle has a gripping portion 34 in the center and a space between the flanges provides a convenient and comfortable spot to grip the handle for carrying the changing caddy.

Figure 4:
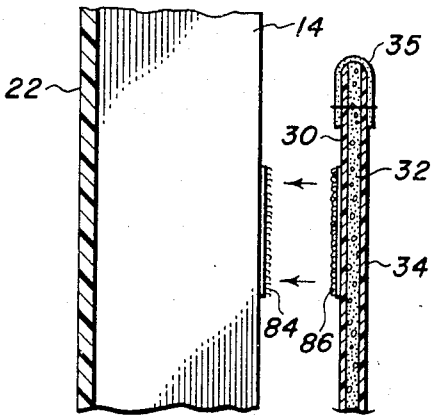
FIG. 4 is a section view taken along line 4—4 of FIG. 1.

The changing pad 36 is generally rectangular in configuration and has a flat changing surface 38 that is preferably at least water resistant. The changing surface has two ends 40 and 42 and two sides 44 and 46. One of the ends 40 is attached to the sides 44 and 46 so that the pad assumes a generally scoop shaped configuration when it is open, as seen in FIG. 2. Preferably the pad is a layered assembly as shown in FIG. 4 having an inner moisture resistant layer 30 of a material such as a thin plastic sheet such as vinyl, a layer 32 of resilient padding material such as urethane foam, and an outer decorative layer 34, preferably another plastic layer. An edge binding 35 is preferably sewn along the edges of the pad. Changing pads per se are well known and the selection of the materials comprising the pad forms no part of this invention.

Figure 3:
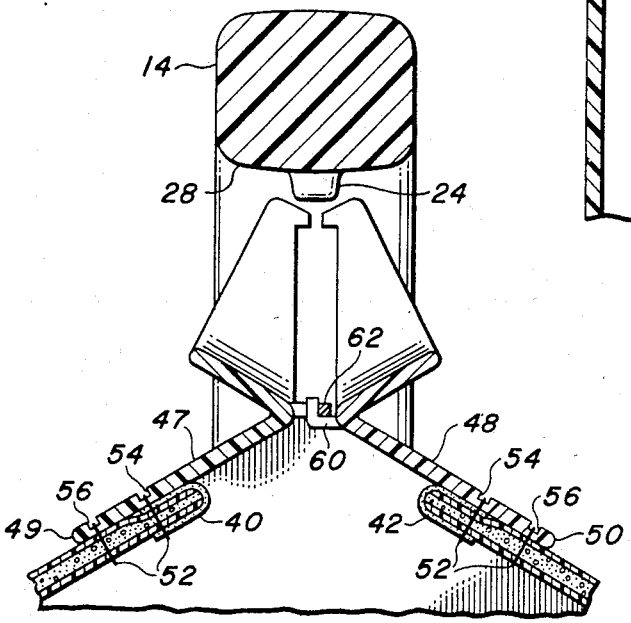
FIG. 3 is a section view taken along line 3—3 of FIG. 1.

End plates 47 and 48 are sewn to each end 40 and 42 of the pad 36 for attaching the pad to the handle 14 of the basket 12 when the changing caddy of this invention is in its transportable configuration. The construction of the end plates can be most readily appreciated by reference to FIGS. 1–3. The end plates are preferably molded from a plastic or other suitable material. The end plates are generally V-shaped in cross-section as shown in FIG. 3. One leg of each end plate 49, 50 is attached to the edge of one end of the pad by two lines of stitching 52, and adhesive, or by welding or the like. Preferably, where the end plate is secured to the pad by stitching, one or more grooves 54 and 56 are formed in one leg of the end plate to guide the needles.

Figure 5:
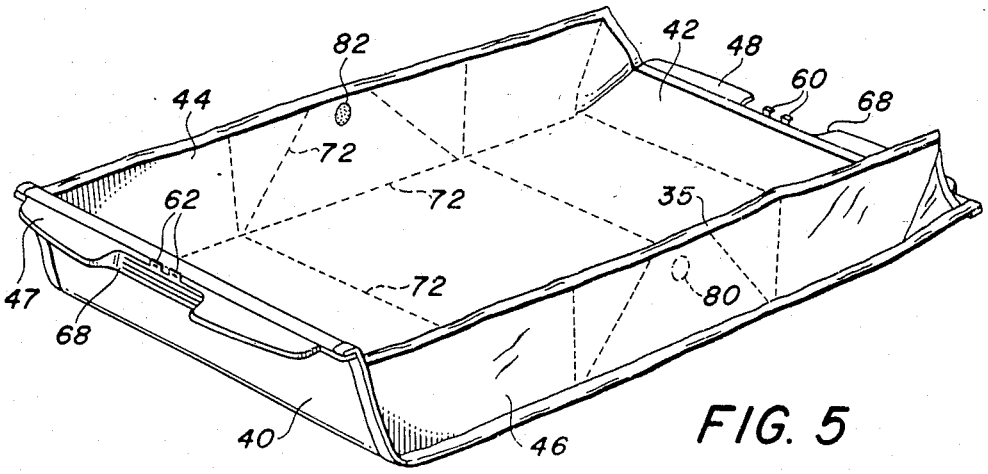
FIG. 5 is a perspective view of the changing pad of the changing caddy of this invention in its ready for use configuration with the basket removed.

The end plates have one or more cooperating hook and ring fastener elements 60 and 62 thereon for connecting the plates together adjacent the handle as shown in FIGS. 1 and 3. While one ring and one hook are sufficient and are preferred, two or more such combinations may be used if desired. As can be seen in FIGS. 3 and 5, the hooks and rings are preferably located near the centers of the end plates. Preferably, one leg of each end plate has a generally U-shaped center portion 68 for providing an opening gripping the gripping portion of said handle.

Referring now to FIG. 5, the pad itself is provided with a plurality of fold lines 72, illustrated as dotted lines in the figure. For clarity only exemplary fold lines are numbered. Preferably, when the pad is made from plastic material the fold lines are formed directly in the pad by stitching the upper and lower pad layers together. When folded along the lines shown in FIGS. 2 and 5, the pad assumes the shape shown in FIG. 1 and forms a neat, compact cover around the basket and its contents. The ends 40 and 42 of the pad are attached adjacent to the handle 14 by the end plates 47 and 48 and the sides 44 and 47 46 of the pad are attached to the ends of the basket by the fasteners 80 and 82 located on the handle and on the inside of the pad. FIG. 4 shows a hook fastener member 84 attached to the handle and a loop fastener member 86 attached to the inner surface of the pad. Preferably the fasteners are of the hook and loop variety commonly available under the trademark VELCRO. Such fasteners can conveniently be adhesively secured to the basket and sewn or adhesively secured to the inside of the pad at the positions that can be best seen in FIGS. 2 and 5.

While the invention has been described in connection with a presently preferred embodiment thereof, various modifications and changes may be made to those skilled in the art without departing from the true spirit and scope of the invention which accordingly is intended to be defined solely by the following claims.

What is claimed is:

1. A changing caddy for carrying the items necessary to change an infant and providing a changing pad, comprising:

a basket having a generally upstanding U-shaped handle attached to a generally rectangular body having four sides;

a changing pad comprising a quilted assembly of a moisture resistant layer, a resilient padding layer, and an outer layer, said pad having a plurality of fold lines for causing the pad to assume the shape of the outside configuration of the basket when folded, said pad comprising first and second sides and first and second ends; and means on the said basket and means on said pad for removably attaching said first and second ends of said pad in place adjacent to said handle and for removably attaching said first and second sides of said pad to two of said four sides of said body.

2. The changing caddy of claim 1 wherein one of the ends of said pad is attached to two of the sides of the pad so that the pad is generally scoop shaped, with said one end and said two sides forming three generally upstanding sidewalls and said moisture resistant layer forming a base.

3. The changing caddy of claim 1 wherein said handle comprises a gripping portion and a flange attached adjacent to said gripping portion.

4. The changing caddy of claim 3 comprising a pair of end plates attached to said first and second ends of said pad and wherein said means on said pad for attaching said ends adjacent to said handle comprises interconnecting means on said end plates.

5. The changing caddy of claim 4 wherin said end plates comprise generally U-shaped center portions for providing an opening for gripping said gripping portion of said handle.

6. The changing caddy of claim 4 wherein said end plates are sewn to said first and second ends of said pad.

7. The changing caddy of claim 4 wherein said end plates comprise first and second generally V-shaped members having first and second legs, said first legs attached to said ends of said pad.

8. The changing caddy of claim 7 wherein saids interconnecting means comprises hook means on one of said end plates aligned with loop means on the other of said end plates when said pad is folded around said basket.

9. The changing caddy of claim 1 wherein said means for removably attaching said first and second sides to two of said four sides of said body comprises hook and loop fastener means attached to said sides of said pad and said sides of said basket.

10. The changing caddy of claim 1 wherein said plurality of fold lines comprises a plurality of lines of stitching.

11. A changing caddy for carrying the items necessary to change an infant and providing a changing pad, comprising:

a basket having a generally upstanding U-shaped handle attached to a generally rectangular body having four sides;

a changing pad having at least one moisture resistant surface, said pad having a plurality of fold lines for causing the pad to assume the shape of the outside configuration of the basket when folded, said pad comprising first and second sides and first and second ends; and means on the said basket and means on said pad for removably attaching said first and second ends of said pad in place adjacent to said handle with said handle extending through spaced apart edge portions of said pad and for removably attaching said first and second sides of said pad to two of said four sides of said body.

12. A changing caddy for carrying the items necessary to change an infant and providing a changing pad, comprising:

a basket having a generally upstanding U-shaped handle, said handle having a gripping portion and a flange attached adjacent to said gripping portion and being attached to a generally rectangular body having four sides;

a changing pad having at least one moisture resistant surface, said pad having a plurality of fold lines for causing the pad to assume the shape of the outside configuration of the basket when folded, said pad comprising first and second sides and first and second ends;

means on said basket and means on said pad for removably attaching said first and second sides of said pada to two of said four sides of said body; and a pair of end plates attached to said first and second ends of said pad and interconnecting means on said end plates for removably attaching said first and second ends of said pad in place adjacent to the handle.

13. The changing caddy of claim 12 wherein said end plates comprise generally U-shaped center portions for providing an opening for gripping said gripping portion of said handle.

14. The changing caddy of claim 12 wherein said end plates are sewn to said first and second ends of said pad.

15. The changing caddy of claim 12 wherein said end plates comprise first and second generally V-shaped members having first and second legs, said first legs attached to said ends of said pad.

16. The changing caddy of claim 15 wherein said interconnecting means comprises hook means on one of said end plates aligned with loop means on the other of said end plates when said pad is folded around said basket.

* * * * *